US006510908B2

(12) United States Patent
Borgman

(10) Patent No.: US 6,510,908 B2
(45) Date of Patent: Jan. 28, 2003

(54) BLASTHOLE DRILL WITH ROTARY HEAD CARRIAGE RESILIENTLY HELD ON A MAST

(75) Inventor: Neil E. Borgman, Muskego, WI (US)

(73) Assignee: Hernischfeger Technologies, Inc., Wilmington, DE (US)

( * ) Notice: Subject to any disclaimer, the term of this patent is extended or adjusted under 35 U.S.C. 154(b) by 0 days.

(21) Appl. No.: 09/681,133

(22) Filed: Jan. 18, 2001

(65) Prior Publication Data

US 2001/0009205 A1 Jul. 26, 2001

(51) Int. Cl.[7] ..... E21B 19/084; E21B 15/00; B23Q 5/00

(52) U.S. Cl. ..... 175/203; 175/162; 175/220; 173/145

(58) Field of Search ..... 175/161, 162, 175/203, 220; 173/145, 147

(56) References Cited

U.S. PATENT DOCUMENTS 3,867,989 A * 2/1975 Hisey et al. ..... 173/147
4,049,064 A * 9/1977 Chubb et al. ..... 173/147
4,371,041 A * 2/1983 Becker et al. ..... 173/147
4,605,078 A * 8/1986 Bukovitz et al. ..... 175/113
5,622,232 A * 4/1997 Whisenhunt ..... 175/52
5,653,297 A * 8/1997 Whisenhunt ..... 175/162
6,298,926 B1 * 10/2001 Dalkert et al. ..... 175/209
6,321,859 B1 * 11/2001 Boyd ..... 152/5

* cited by examiner

*Primary Examiner*—William Neuder
*Assistant Examiner*—Jennifer H Gay
(74) *Attorney, Agent, or Firm*—James Earl Lowe, Jr.

(57) ABSTRACT

A blast hole drill comprising a mast including two parallel mast cords, a carriage, and a rotary head mounted on the carriage and adapted to engage a drill pipe. The rotary head includes a drive pinion on a rack on one of the mast cords, and the drive pinion is on one side of at least one of the mast cords. A backup wheel assembly is on the opposite side of the respective mast cord opposite the pinion and includes a wheel holding assembly support rotatably supporting a backup wheel, a yoke having an opening through the yoke, a plunger threadably received in the yoke opening, the wheel assembly support being slidably received on the plunger, and Belleville washers extending around the plunger and between the yoke and the wheel holding assembly support, the Belleville washers extending between an abutment on the plunger and the wheel holding assembly support.

6 Claims, 5 Drawing Sheets

BLASTHOLE DRILL WITH ROTARY HEAD CARRIAGE RESILIENTLY HELD ON A MAST

BACKGROUND OF INVENTION

The present invention relates generally to blast hole drills which have a mast and a rotary head mounted on a carriage for movement along the mast. More particularly, the present invention is directed to the manner in which the rotary head carriage is mounted for movement along the mast.

Blast hole drills are large earth drilling machines typically used in mining operations to drill holes for explosives. A conventional blast hole drill comprises a frame supported by crawlers for movement over the ground. A drill deck having a large rectangular opening is supported by the frame. A mast is supported by the frame for movement relative to the frame between a vertical position and a plurality of non-vertical positions. A drill pipe or drill string is supported relative to the mast, and a drill cutter bit is connected to a lower end of the drill pipe. The drill pipe extends through the opening of the drill deck and the shape of the opening allows the drill pipe to be positioned at the desired angle relative to the drill deck for drilling purposes. A rotary head engages an upper end of the drill pipe and moves along the mast. The rotary head rotates the drill pipe, and thus the drill cutter bit, into the ground.

The rotary head is mounted on a carriage which in turn is mounted on the cords forming the mast. The mast cords include a rack, and the rotary head includes a drive opinion which engages the rack in order to move the carriage up and down along the mast. The rotary head carriage is mounted on the mast by having the drive pinion and an idler pinion spaced from the drive opinion on one side of a mast cord, and a plurality of backup wheel assemblies on the opposite side of the cord opposite each of the pinions.

In prior constructions, the backup wheels were fixedly held in place against the mast cord. A mechanism, such as an adjustable mounting hole, was provided in order to adjust the position of the backup wheels relative to the mast. By varying the distance between the backup wheels and the mast cord, a clearance between the mast cord and the backup wheels was provided. This clearance was necessary to allow for differences in tolerances in the width of the mast cord as the rotary head moved along the mast. This spacing, however, permitted some movement of the rotary head carriage relative to the mast. This resulted in occasional vibration or "chatter" of the rotary head relative to the mast. This chatter produced undesirable noise and damage to the rotary head carriage and the mast.

SUMMARY OF INVENTION

One of the principal features of this invention is the provision of a mechanism for mounting the rotary head on the mast, with the rotary head being held against the mast with sufficient force so that no chatter can occur between the rotary head and the mast.

Another of the principal features of the invention is the provision of such a mechanism where some allowance for changes in width of the mast cords is provided for.

The invention provides a blast hole drill comprising a frame supported for movement over the ground, and a mast supported by the frame for movement relative to the frame between a vertical position and a plurality of non-vertical positions, the mast being formed of a plurality of mast cords, at least two of which are fixed in parallel relationship to each other. The drill further includes a carriage, a rack on at least one of the parallel mast cords, and a rotary head mounted on the carriage and adapted to engage a drill pipe, the rotary head including a drive pinion on the rack for moving the rotary head carriage along the mast.

The drill also includes means for mounting the carriage on the parallel mast cords, the mounting means comprising having the drive pinion on one side of at least one of the mast cords, and a backup wheel assembly on the opposite side of the respective mast cord opposite the pinion and including a wheel holding assembly support rotatably supporting a backup wheel. The backup wheel assembly also includes a yoke having an opening through the yoke, and a plunger received in the yoke opening. The wheel assembly support is slidably received on the plunger, and resilient means extends around the plunger and between the yoke and the wheel holding assembly support. The backup wheel assembly also further includes means for fixing the resilient means against the wheel assembly support so that the wheel is pressed against the mast cord by the resilient means.

More particularly, the rotary head also includes an idler pinion spaced from the drive pinion. The drive pinion and the idler pinion are on one side of each of the mast cords, and there are at least a pair of backup wheel assemblies on the opposite side of the respective mast cord, each of the wheel assemblies being opposite one of the pinions. Further, there are at least two plungers, each of which is received in one of the yoke openings.

Still more particularly, the means for fixing the resilient means against the wheel assembly support comprises the resilient means extending between an abutment on the plunger and the wheel holding assembly support, and means for moving and fixing the plunger toward the mast cord relative to the yoke so that the wheels are held against the mast cord by the resilient means.

Still more particularly, the means for moving and fixing the plunger toward the mast cord relative to the yoke comprises the plunger being threaded in the opening through the yoke.

Other features and advantages of the invention will become apparent to those skilled in the art upon review of the following detailed description, claims and drawings in which like numerals are used to designate like features.

BRIEF DESCRIPTION OF DRAWINGS

FIG. 4 is a sectional view through the backup wheel, the mast cord, the rack and the idler pinion. The backup wheel assembly is shown with the backup wheels retracted.

FIG. 5 is a sectional view similar to FIG. 4 only now the backup wheels are pressed against the mast cord.

Figure 1:
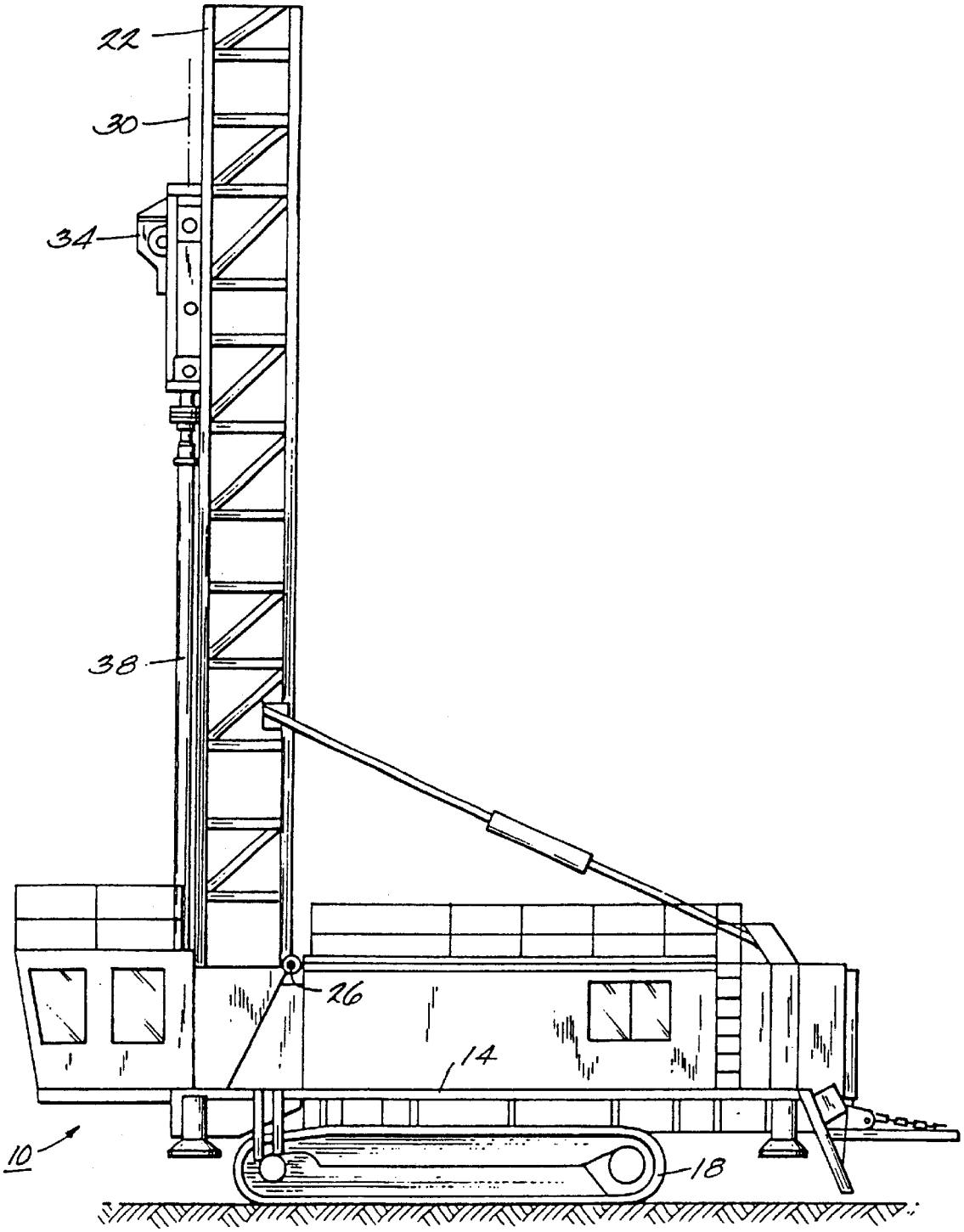
FIG. 1 is a side elevational view of a blast hole drill in which the present invention is employed.

Before the embodiments of the invention are explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein are for the purpose of description and should not be regarded as limiting. The use of "including" and "comprising" and variations thereof herein is meant to encompass the items listed thereafter and equivalents thereof as well as additional items and equivalents thereof The use of "consisting of" and variations thereof herein is meant to encompass only the items listed thereafter and the equivalents thereof.

DETAILED DESCRIPTION

Illustrated in FIG. 1 is a blast hole drill 10 in which the present invention is employed. The blast hole 10 comprises a frame 14 supported by crawlers 18 for movement over the ground. A mast 22 is supported by the frame 14 for movement relative thereto about a generally horizontal axis 26 between a substantially vertical position (as shown) and a number of angled or non-vertical positions.

A rotary head 34 is movable relative to the mast 22 along the drill hole axis 30. The rotary head 34 is selectively engageable with an upper end of a drill pipe 38 which is supported relative to the mast 22. The frame 14, crawlers 18, mast 22, rotary head 34 and drill pipe 38 can be of conventional construction and do not require a detailed description. Known blast hole drills are described, for example, in U.S. Pat. Nos. 5,622,232 and 5,653,297 both to Whisenhunt, which are hereby incorporated herein by reference.

Figure 2:
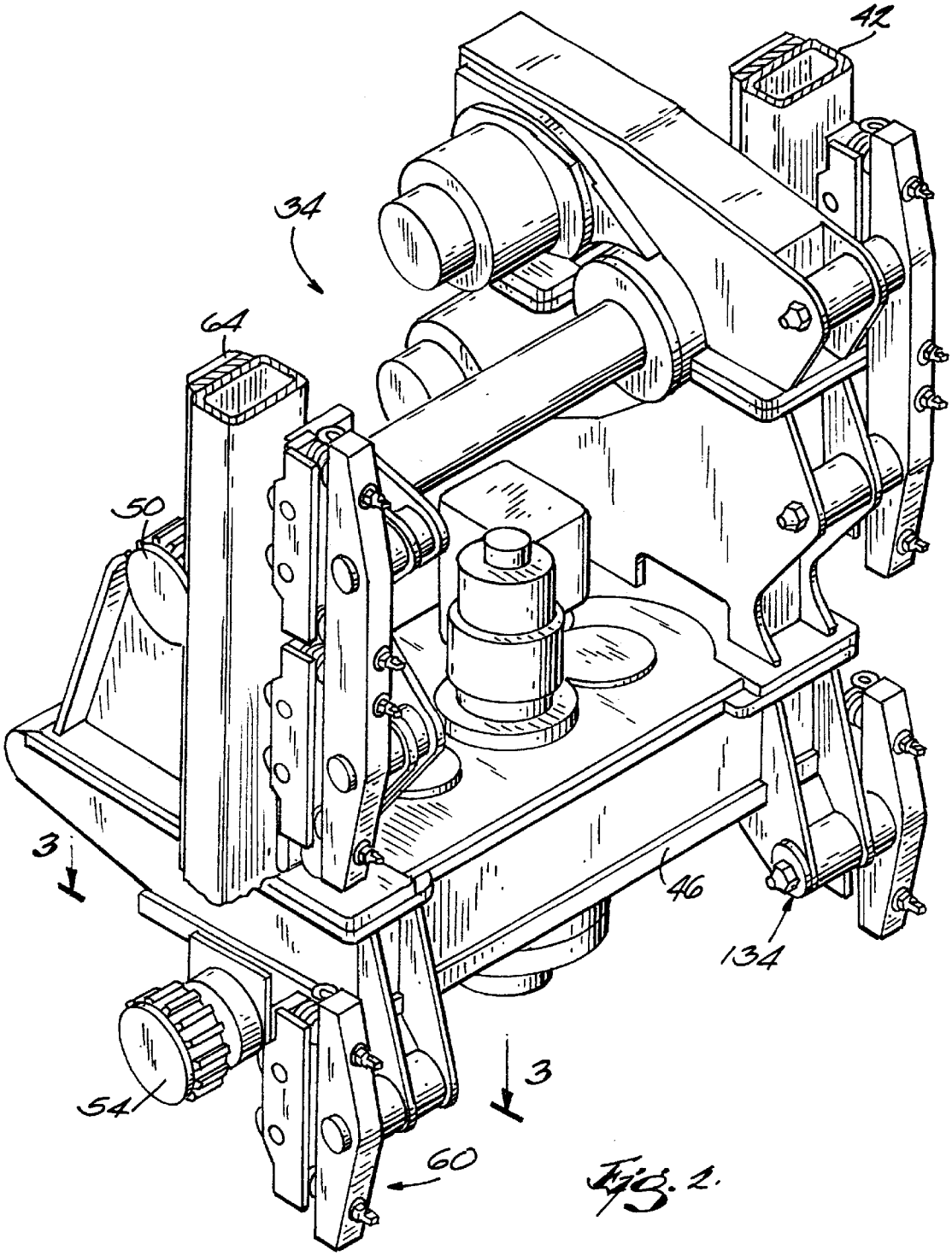
FIG. 2 is a perspective view of the rotary head carriage mounted on the cords forming the mast. Only part of the mast cords are shown.
Figure 3:
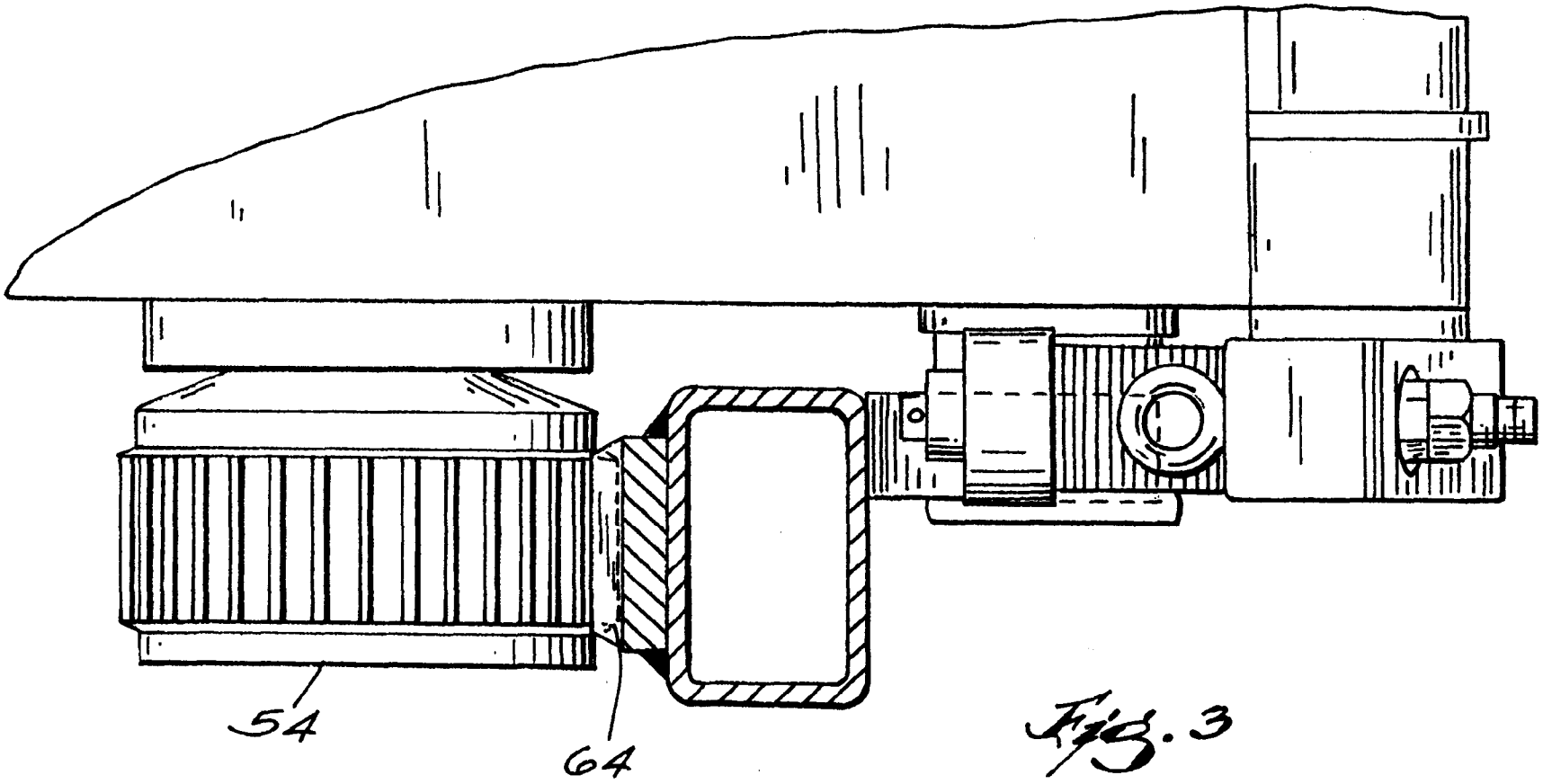
FIG. 3 is a partial top view taken along the line 3 3 in FIG. 2 showing an idler pinion on one side of the mast and a backup wheel assembly on the opposite side of the mast.

As illustrated in FIG. 1, a plurality of structural elements or cords 42 is fixed together to form the mast 22. As shown in FIG. 2, two parallel side cords support the rotary head 34 for movement along the mast 22. The rotary head 34 is carried on a carriage 46 held on each of the mast cords 42 by means for mounting the carriage on the parallel mast cords. The mounting means comprises a combination of a drive pinion 50 for moving the rotary head carriage along the mast, and an idler pinion 54 spaced from the drive pinion 50 on one side of the mast cord 42. The mounting means also includes three pairs of backup wheel assemblies 60 on the opposite side of the mast cord 42.

More particularly, the drive pinion 50 and idler pinion 54 engage a rack 64 on the mast cord 42 in order to move the rotary head 34 along the mast. When the drive pinion 50 turns in order to move the rotary head 34, the drive pinion 50 attempts to lift off of the rack 64 by a separating force, but is prevented from doing so by the backup wheel assemblies 60.

Figure 4:
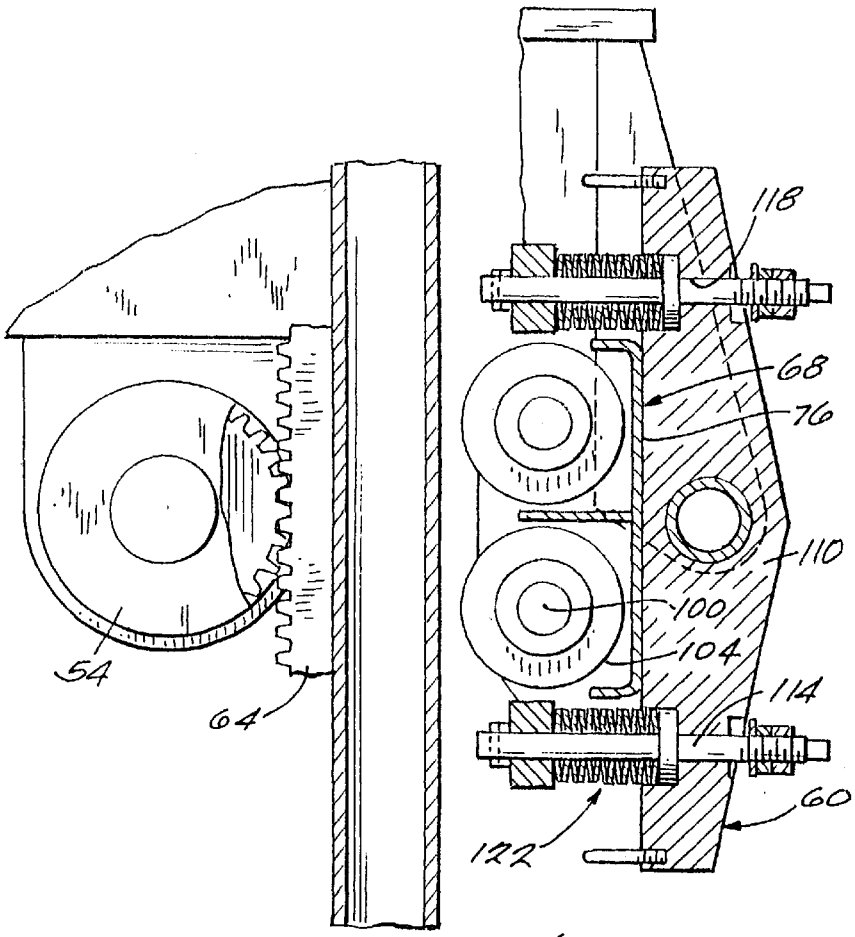
Figure 6:
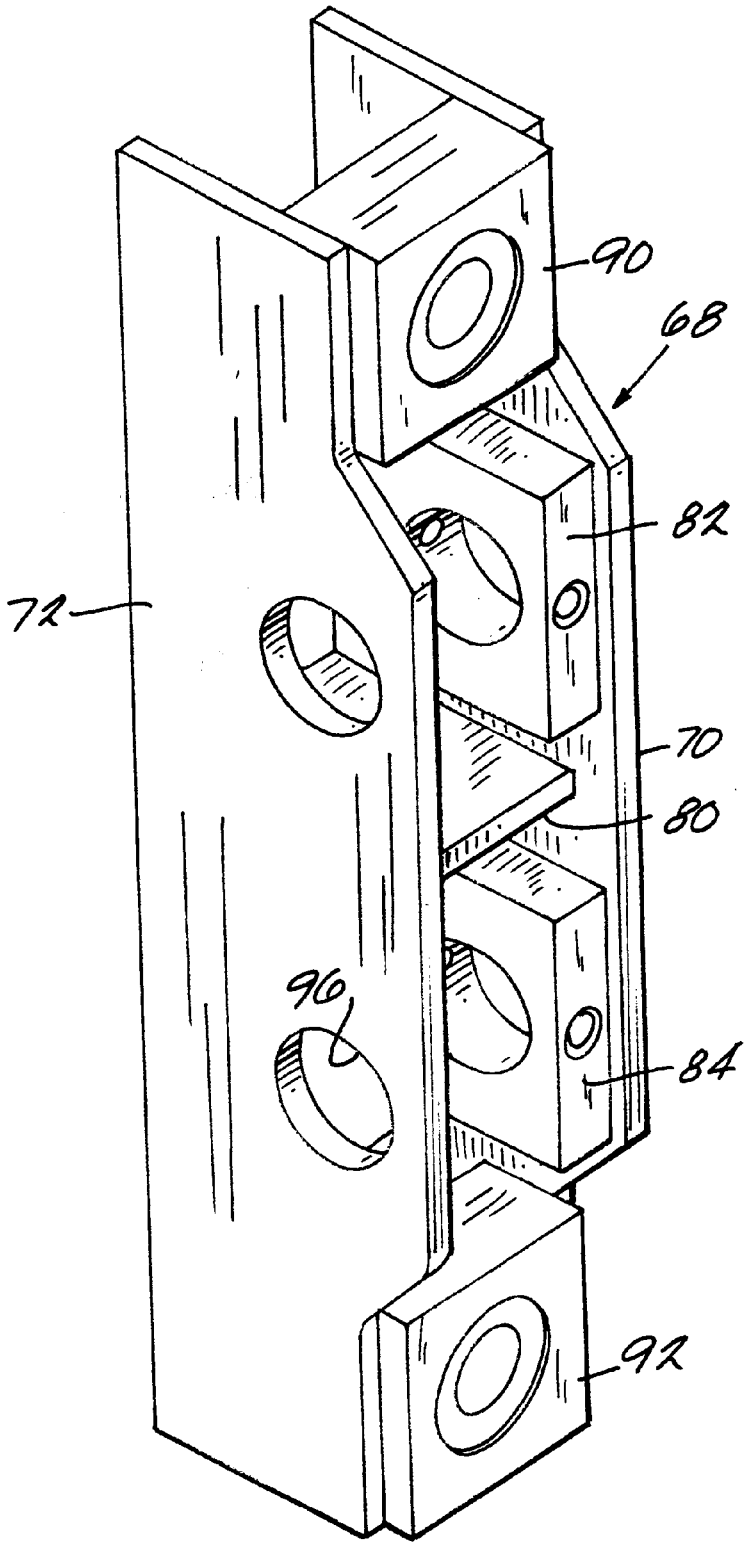
FIG. 6 is a perspective view of a backup wheel holding assembly support.

As shown in FIG. 4, each of the backup wheel assemblies 60 include a wheel holding assembly support 68 comprising a plurality of welded together plates. As illustrated in FIG. 6, the plates include two side plates 70 and 72, a top plate, a dividing plate 80, two reinforcement plates 82 and 84, and two plunger plates 90 and 92. A bore cut through the side plates and the reinforcement plates receives an axle 100 (see FIG. 4) having a sold steel wheel 104 mounted thereon. The wheels 104 are rotatable relative to the assembly support 68.

As shown in FIG. 4, the backup wheel assemblies 60 further include a yoke 110, and a pair of plungers 114, and means for fixing a resilient means against the wheel assembly support 68 so that said wheels are pressed against the mast cord by the resilient means. More particularly, each of the plungers is received in a means for moving and fixing the plunger comprising a threaded bore 118 through the yoke 110, and the resilient means is in the form of Belleville washers 122. In otherless preferred embodiments, other resilient materials can be used.

After extending through the yoke 110 and the Belleville washers 122, the free end of the plunger 114 extends through a hole in the respective support plunger plate 90 or 92. A bolt 126 held in a bore in the free end of the plunger keeps the wheel holding assembly support 68 attached to the yoke 110, and permits the wheel holding assembly support 68 to move relative to the yoke 110 and the plunger 114.

Figure 5:
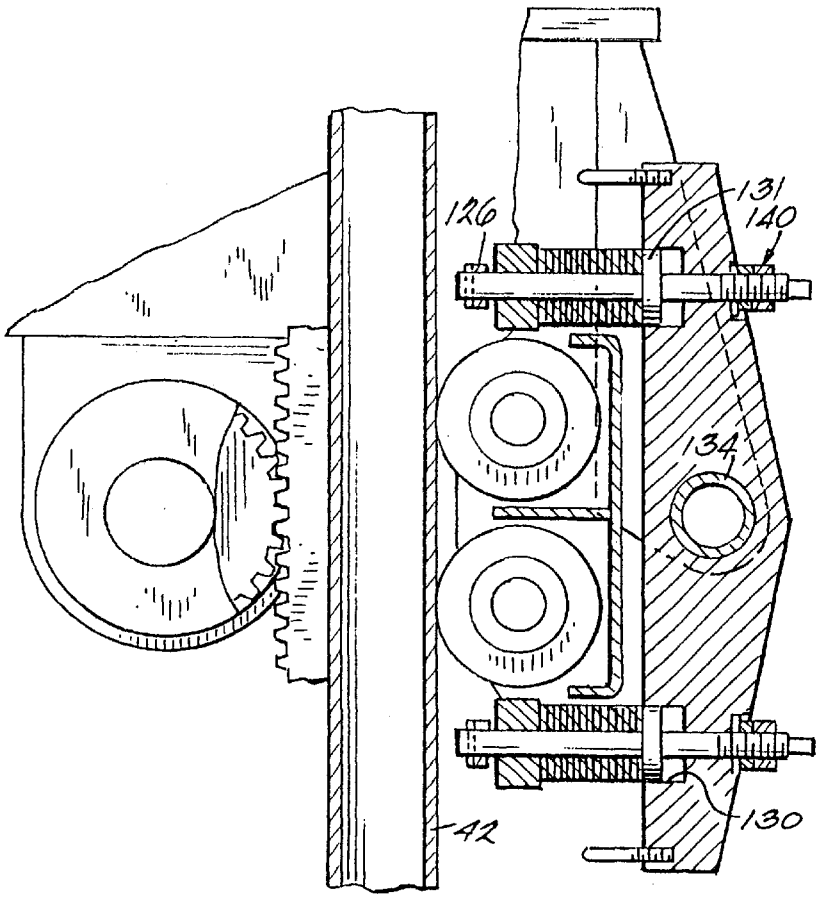
FIGS. 4 and 5 show an the installation procedure for installing the backup wheels.

As illustrated in FIGS. 4 and 5, the yoke 110 has two ends, with a plunger bore 118 near each of the ends, with the plunger bore 118 on one side being enlarged to form a recess 130 to hold therein the Belleville washers 122. In the preferred embodiment, there are 14 one quarter inch Belleville washers mounted on each plunger shaft between an abutment 131 on the plunger and the respective plunger plate. The washers are arranged in seven pairs of two, with each pair comprising two cupped washers with the cup openings facing each other. A travel of 0.315 inches produces 6492 lbs. of force. Total travel to flat is 0.630 inches.

As shown in FIG. 2, the rotary head carriage 46 is mounted on the mast cords 42 by placing the drive and idler pinions on the rack 64, and then by attaching each yoke 110 to the rotary head carriage 46 by a pin 134 secured to the carriage 46 and to the yoke 110. The wheel assembly support is then positioned as follows.

Initially, each of the plungers 114 has its abutment 131 bottomed in its respective recess 130. Each of the plungers 114 in a yoke 110 is then turned in unison in its threaded bore 118. As each plunger turns, it advances away from its respective yoke 110 towards the mast cord 42. As the plunger 114 advances, so does the yoke abutment 131. Since the Belleville washers 122 are disposed around the plunger shaft and between the abutment 131 and the respective wheel holding assembly plunger plate, the wheel holding assembly support 68 is advanced toward the mast cord 42 as the plunger 114 is threaded toward the mast cord 42 because the stack of Belleville washers 122 is urged against the wheel holding assembly support 68. When the wheels 104 contact the mast cord 42, further threading advancement of the plunger 114 causes compression of the Belleville washers 122. After the wheels 104 are seated against the mast cord 42, both plungers are then turned a further two and a half full turns. This loads the washers to 6492 lbs, which is equal to the drive pinion separating force.

This applies a spring force to the wheel holding assembly support 68, thus resulting in a spring force holding the wheels 104 against the mast 22. The spring force opposes the separating force of the drive pinion 50, thus keeping the drive pinion 50 in contact with the rack 64. Each plunger 114 is secured in place with a hex jam nut and hex nut combination 140. Wrench flats are provided on the end of the plungers 114 to aid in the turning of the plunger 114.

In other less preferred embodiments (not shown), other means for fixing the resilient means relative to the mast cord can be used. For example, the plunger abutment could be omitted, and the position of the yoke relative to the carriage and the mast cord could be varied in order to press the resilient means against wheel assembly support 68. This is less preferred, however, because of the difficulties which would be inherent in getting the yoke positioned correctly.

Various of the other features of the invention are set forth in the following claims.

What is claimed is:

1. A blast hole drill comprising:

a frame supported for movement over the ground, a mast supported by the frame for movement relative to the frame between a vertical position and a plurality of non-vertical positions, said mast being formed of a plurality of mast cords, at least two of which are fixed in parallel relationship to each other, a carriage, a rack on at least one of said parallel mast cords, a rotary head mounted on said carriage and adapted to engage a drill pipe, said rotary head including a drive pinion on said rack for moving said rotary head carriage along said mast, and means for mounting said carriage on said parallel mast cords, said mounting means having said drive pinion on one side of at least one of the mast cords, and a backup wheel assembly on the opposite side of the respective mast cord opposite said pinion and including a wheel holding assembly support rotatably supporting a backup wheel, a yoke attached to said carriage and having an opening through the yoke, a plunger received in the yoke opening, said wheel assembly support being slidably received on said plunger, resilient means extending around said plunger and between the yoke and the wheel holding assembly support for biasing said wheel holding assembly support away from said yoke, and means for fixing the resilient means against the wheel assembly support so that said wheel is pressed against said mast cord by said resilient means.

2. A blast hole drill in accordance with claim 1 wherein said means for fixing the resilient means against the wheel assembly support comprises said resilient means extending between an abutment on the plunger and the wheel holding assembly support, and means for moving and fixing the plunger toward the mast cord relative to said yoke so that the wheels are held against the mast cord by the resilient means.

3. A blast hole drill in accordance with claim 2 wherein said means for moving and fixing the plunger toward the mast cord relative to said yoke comprises said plunger being threaded in said opening through said yoke.

4. A blast hole drill comprising:

a frame supported for movement over the ground, a mast supported by the frame for movement relative to the frame between a vertical position and a plurality of non-vertical positions, said mast being formed of a plurality of mast cords, at least two of which are fixed in parallel relationship to each other, a carriage, a rack on at least one of said parallel mast cords, a rotary head mounted on said carriage and adapted to engage a drill pipe, said rotary head including a drive pinion on said rack for moving said rotary head carriage along said mast and an idler pinion spaced from the drive pinion, and means for mounting said carriage on said parallel mast cords, said mounting means having said drive pinion and said idler pinion on one side of each of the mast cords, and at least a pair of backup wheel assemblies on the opposite side of the respective mast cord, each of said wheel assemblies being opposite one of said pinions and including a wheel holding assembly support rotatably supporting a pair of backup wheels, a yoke attached to said carriage and having two spaced openings through the yoke, at least two plungers, each of which is received in one of the yoke openings, said wheel assembly support being slidably received on said plungers so that said pair of backup wheels are generally aligned with said two plungers, resilient means extending around each of said plungers and between the yoke and the wheel holding assembly support for biasing said wheel holding assembly support away from said yoke, and means for fixing the resilient means against the wheel assembly support so that said wheels are pressed against said mast cord by said resilient means.

5. A blast hole drill in accordance with claim 4 wherein said means for fixing the resilient means against the wheel assembly support comprises said resilient means extending between an abutment on the plunger and the wheel holding assembly support, and means for moving and fixing the plunger toward the mast cord relative to said yoke so that the wheels are held against the mast cord by the resilient means.

6. A blast hole drill in accordance with claim 5 wherein said means for moving and fixing the plunger toward the mast cord relative to said yoke comprises said plunger being threaded in said opening through said yoke.

* * * * *